US005480072A

United States Patent [19]

Ripley

[11] Patent Number: 5,480,072

[45] Date of Patent: Jan. 2, 1996

[54] FLUID POURING GUIDE

[76] Inventor: Robert L. Ripley, P.O. Box 219, Glenco, Okla. 74058

[21] Appl. No.: 241,435

[22] Filed: May 11, 1994

Related U.S. Application Data

[63] Continuation-in-part of Ser. No. 122,282, Oct. 18, 1993, abandoned.

[51] Int. Cl.[6] ..... B65D 5/74

[52] U.S. Cl. ..... 222/460; 141/331; 141/334

[58] Field of Search ..... 222/460; 141/331, 141/337, 333, 334, 339

[56] References Cited

U.S. PATENT DOCUMENTS

| | | | |
|---|---|---|---|
| 1,965,356 | 7/1934 | Rittenhouse | 222/460 |
| 2,100,888 | 11/1937 | Vine | 141/337 |
| 2,411,384 | 11/1946 | Miller et al. | 141/331 |
| 2,520,549 | 8/1950 | Jacobsen | 222/460 |
| 2,580,811 | 1/1952 | Martinsen | 222/460 |
| 2,606,327 | 8/1952 | Eckart et al. | 141/331 |
| 2,812,784 | 11/1957 | Palmer | 141/98 |
| 3,206,083 | 9/1965 | Nishina | 222/460 |
| 3,537,623 | 9/1968 | Fisher | 222/460 |
| 3,750,722 | 8/1973 | Nowak | 222/460 |
| 4,108,222 | 8/1978 | Kaufman | 141/337 |
| 4,226,268 | 10/1980 | Wasser | 141/331 |
| 4,338,984 | 7/1982 | Kronberg | 141/331 |
| 4,800,875 | 1/1989 | Ray | 128/92 |
| 4,940,189 | 7/1990 | Cremonese | 229/1.5 |

FOREIGN PATENT DOCUMENTS

| | | | |
|---|---|---|---|
| 2497786 | 7/1982 | France | 141/337 |
| 2252292 | 8/1992 | United Kingdom | 141/337 |
| 2253838 | 9/1992 | United Kingdom | 141/331 |

*Primary Examiner*—Andres Kashnikow
*Assistant Examiner*—Lisa Douglas
*Attorney, Agent, or Firm*—Robert K. Rhea

[57] ABSTRACT

As an article of manufacture, a fluid pouring guide is formed from a length of rigid sheet material folded to define an open end V-shaped trough having opposing marginal side edges converging toward one end.

6 Claims, 1 Drawing Sheet

FLUID POURING GUIDE

This application is a Continuation-In-Part of an application filed by me in the United States Patent and Trademark Office under Ser. No. 08/122,282 on Oct. 18, 1993, now abandoned for VISION CLEAN ALL DISPENSER.

BACKGROUND OF THE INVENTION

1. Field of the Invention

This invention relates to a new and useful article of manufacture which structurally speaking is generally trough-like and is manually usable for moving liquids or granular material from one container to another.

When a funnel is used, regardless of material, unless it is cleaned in solvent cleaner, carburetor cleaner, gasoline or other type cleaner, it collects dirt from the normal oily film on the inside of the funnel. After the funnel has been used to put oil in an internal combustion engine, the operator places the funnel in a drain rack. When the engine is started in the serviced vehicle, the fan will stir up any loose dust which may settle in the oily film on the inside surface of the funnel.

2. Description of Prior Art

U.S. Pat. No. 4,800,875 issued Jan. 31, 1989 to Ray discloses a surgical funnel of flat bottom up-standing wall channel-like configuration having laterally diverging walls at one end portion to form a reservoir communicating with the reminder of the channel which has an unobstructed exit end with the bottom and wall edges rounded to facilitate lateral movement of the outlet end in a surgical wound for dispensing particulate bone material.

U.S. Pat. No. 2,812,784 issued Nov. 12, 1957 to Palmer discloses a multi-purpose pan which is flat generally triangular-shaped in overall configuration characterized by a pair of walls helically coiled upon themselves at opposing sides of the triangular shape to define a converging path for moving or sorting granular material.

This invention is distinctive over the above named patents by employing a V-shaped trough-like construction for the pouring guide which converges from one end toward its other terminating in a relatively small pointed end which may enter the container to be filled and be self-supporting at its opposite material receiving end.

U.S. Pat. No. 2,580,811 issued Jan. 1, 1952 to Martinsen for DETACHABLE SPOUT FOR CONTAINERS and U.S. Pat. No. 4,338,984 issued Jul. 13, 1982 to Kronberg et al for AUTOMOTIVE FLUID SUPPLY FUNNEL UNIT are believed good examples of the state-of-the-art representing a conical or straight wall-type restricted pouring spout which as previously mentioned is not easily cleaned between uses, such as is applicant's pouring guide.

SUMMARY OF THE INVENTION

A section of rigid sheet material of selected length and width having its opposing side edges converging from one end toward its other end is longitudinally folded at right angle along its longitudinal center line to form a V-shaped open end trough.

The principal object of this invention is to provide an inexpensive, easily cleaned, open end trough-like funneling guide for moving liquid or granular material from one container to another.

Figure 1:
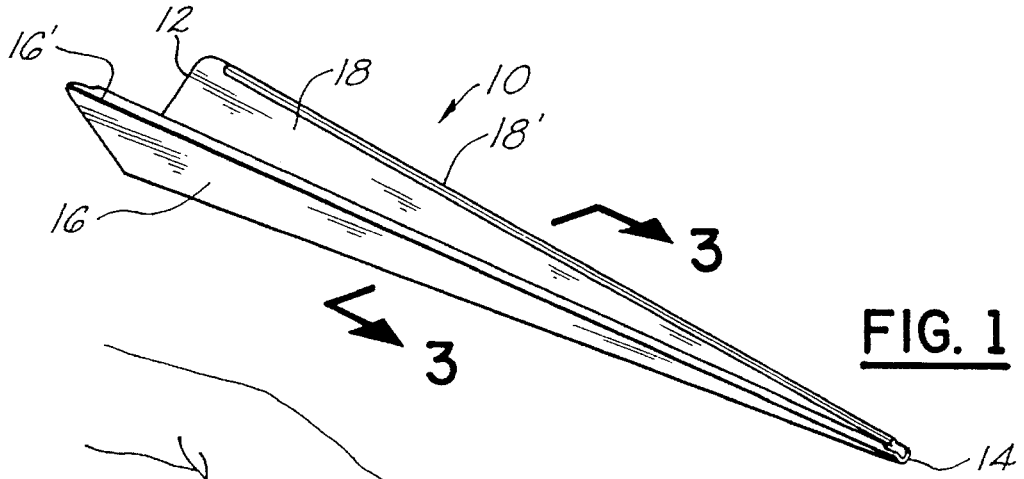
FIG. 1 is a perspective view of the device.
Figure 2:
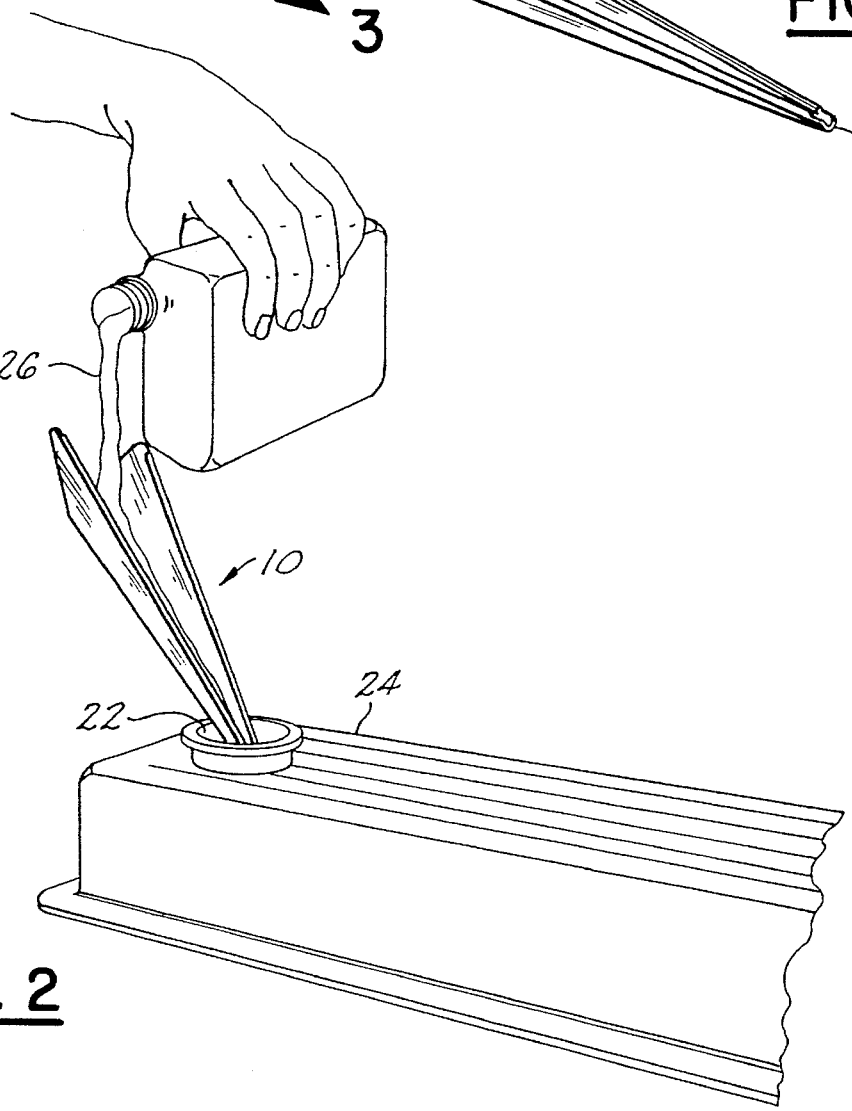
FIG. 2 is a fragmentary perspective view of the device in operative position; and, FIG. 3 is a vertical cross sectional view, to a larger scale, taken substantially along the line 3—3 of FIG. 1.
Figure 3:
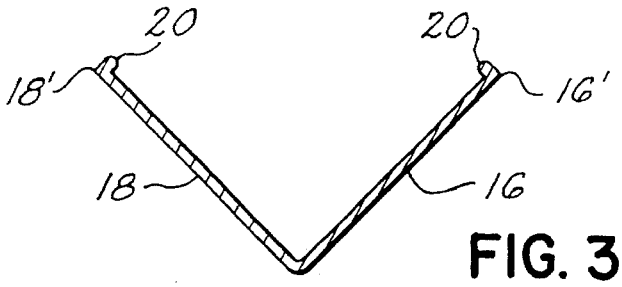

The reference numeral 10 indicates the pouring guide which is preferably formed from flat rigid sheet material of uniform thickness having parallel end surfaces 12 and 14 and a selected width. The sheet material is bent at right angle (FIG. 3) along its longitudinal center line to form a substantially V-shaped open end trough defined by walls 16 and 18. The lateral outer edge surfaces 16' and 18', respectively, of the walls 16 and 18 converge toward the end surface 14 for the purpose presently explained.

Additionally, each of the wall outer edge surfaces 16' and 18' may be provided with a longitudinally extending laterally projecting lip 20 to stiffen each edge 16' and 18'. These lips 20 terminate in close spaced relation with respect to the end surface 14 to prevent restriction of material moving from the larger end toward the smaller end of the trough-like guide 10.

By way of example, I have found that a useful size of the pouring guide 10 may be formed from a strip of material 10 inches (25.4 cm), between its end surfaces 12 and 14 and a width of 3 inches (7.62 cm) at its end surface 12 in which the width of the side walls 16 and 18 is 1½ inches (3.81 cm) adjacent its end 12 and converge toward the end 14 terminating in walls ⅛ inch (0.32 cm) in width.

Operation

In operation the smaller end portion of the guide 10 is placed within the receiving spout of a receptacle, for example, the oil adding spout 22 of a valve rocker arm cover 24 of an automotive engine.

The smaller end portion of the guide 10 is inserted a selected distance into the spout 22 and gravity supports the larger material receiving end of the guide upwardly inclined laterally of the spout 12 so that fluid or ganular material, such as oil indicated by the lines 26, may be poured into the guide and into the spout 22.

The smooth inner and out surfaces of the side walls 16 and 18 are easily wiped clean of oil film after use.

Obviously the invention is susceptible to changes or alterations without defeating its practicability. Therefore, I do not wish to be confined to the preferred embodiment shown in the drawings and described herein.

I claim:

1. As a new article of manufacture, a length of sheet material having opposite marginal side edges converging toward one end edge and having its opposite side portions folded toward each other along its longitudinal axis in upwardly divergent cooperating wall relation in defining an open end trough-like pouring guide, each marginal side edge being provided with a substantially coextensive stiffening member projecting laterally of the respective wall and facing the stiffening member on the opposite wall.

2. The new article according to claim 1 and wherein the converging ends of the opposite marginal side edges are in close proximity to the fold defining the opposite side portions.

3. The new article according to claim 2 and wherein the folded portion of the opposite side portions substantially define a V-shape.

4. The new article according to claim 3 and wherein the stiffening member is an integral laterally projecting lip.

5. An open end trough-like fluid pouring guide, comprising:

a pair of integral walls normal to each other formed from rigid sheet material of uniform thickness, said walls having parallel end edges and having marginal side edges converging toward one end; and, an integral substantially coextensive wall stiffening lip adjacent each said marginal side edge in substantially confronting relation with respect to the lip on the other of said wall.

6. The pouring guide according to claim 5 in which the ratio of the width of each said wall at its said converging end with respect to its opposite end is 1:12.

* * * * *